United States Patent [19]

Curletto

[11] Patent Number: 4,545,276

[45] Date of Patent: Oct. 8, 1985

[54] ELECTRONIC ACCORDION HOUSING AND SUPPORT STAND

[76] Inventor: Giorgio F. Curletto, 6109 Nevada Ave. NW., Washington, D.C. 20015

[21] Appl. No.: 586,339

[22] Filed: Mar. 5, 1984

[51] Int. Cl.[4] ..... G10H 1/00

[52] U.S. Cl. ..... 84/1.01; 84/376 A; 84/376 K

[58] Field of Search ..... 84/1.07, 1.01, 1.04, 84/1.03, 1.05, 1.06, 376 R, 376 A, 376 EA, 376 K; 248/122, 185

[56] References Cited

U.S. PATENT DOCUMENTS 2,861,767 11/1958 Oves et al. ..... 248/122

3,610,802 10/1971 Berwin ..... 84/1.07

*Primary Examiner*—Forester W. Isen

[57] ABSTRACT

An electronic accordion without bellows and without reeds. Control panels and surfaces are provided to maximize convenience to the performer.It is a stationary instrument which can be detached from its sectional tubular supporting platform for portability.

7 Claims, 8 Drawing Figures

ELECTRONIC ACCORDION HOUSING AND SUPPORT STAND

BRIEF SUMMARY OF THE INVENTION

The Electronic Accordion Housing and Support Stand is a conceptual idea inspired by realization of the many discomforts and tribulations that a professional accordionist (including myself the designer) must endure and put up with, while playing the traditional electronic accordions, and its design is aimed to put an end to these problems. To start with the bellows has been eliminated. The shoulder straps are no longer necessary. The Electronic Accordion Housing and Support Stand stands elegantly on its own and provides an attractive built-in seat for the comfort of the accordionist. The main control panel assigned to the right hand, is for the first time, facing the accordionist for maximum efficiency. The bassboard switches are now positioned at a different angle to facilitate their engagement. The control panel for a built-in electronic rhythm unit is arranged in a sunken-in portion of the top section of the instrument for easy and prompt identification. These innovative features make the Electronic Accordion Housing and Support Stand system a decisively major step forward in the evolution of the traditional electronic accordion. It brings comfort, efficiency, style never before available and most importantly, it retains the basic and unique principle of the vertical keyboard and bassboard intact so that the rich and special tradition of the accordion's two separate and different techniques of the right hand and the left hand can be carried on without compromises.

A BRIEF DESCRIPTION OF THE SEVERAL VIEWS OF THE DRAWINGS

Enclosed are eight drawings that I refer to as FIG. 1, FIG. 2, FIG. 3, FIG. 4, FIG. 5A, FIG. 5B, FIG. 5C, and FIG. 5D.

Figure 4:
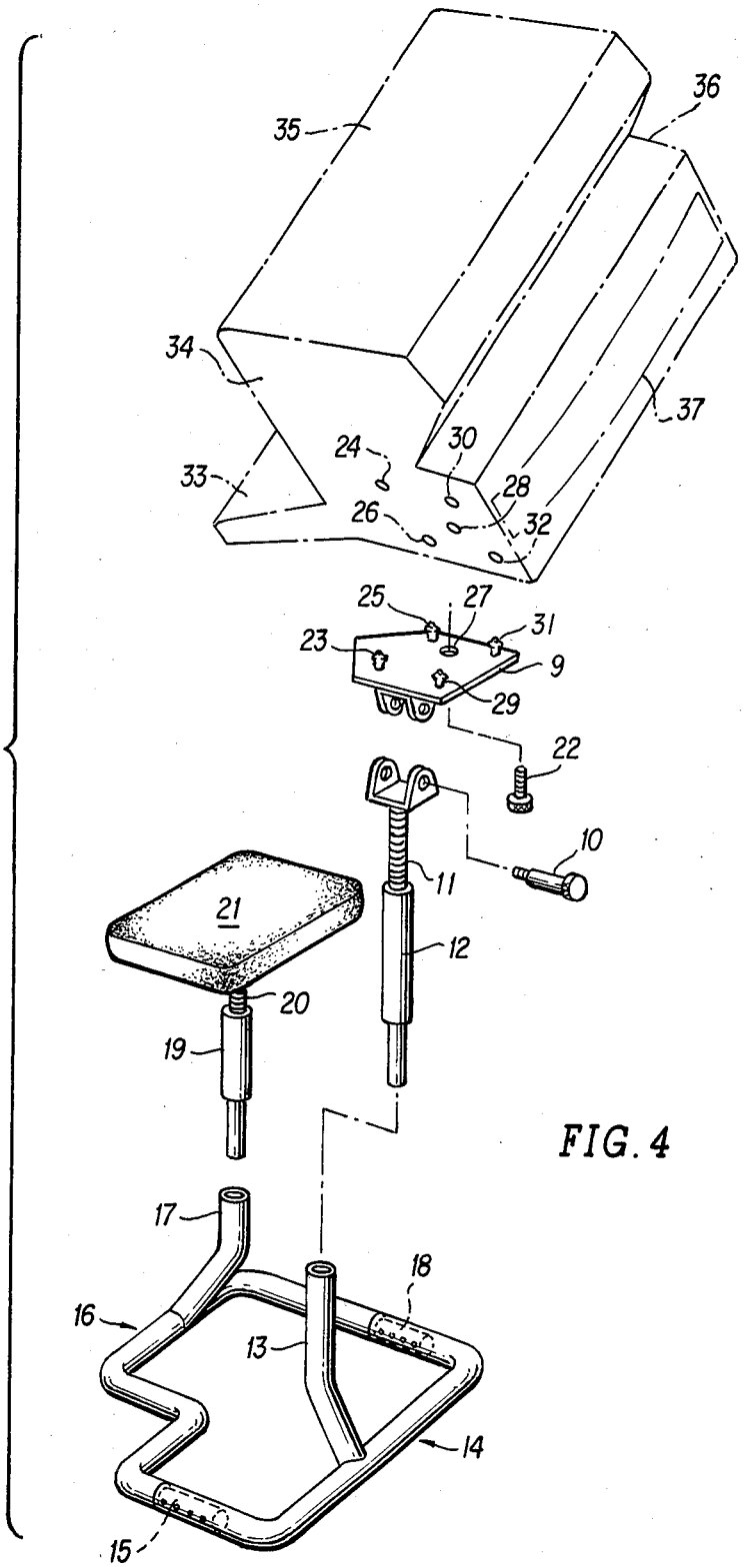

FIG. 4 displays all the different components and the way they interlock with one another (all parts numbered for quick reference).

FIG. 5A, FIG. 5B, FIG. 5C, and FIG. 5D illustrate the convenience and practicality of the fully portable version of the electronic accordion housing's support stand named the "Brief-Case."

DETAILED DECRIPTION OF THE ELECTRONIC ACCORDION HOUSING AND SUPPORT STAND

Figure 1:
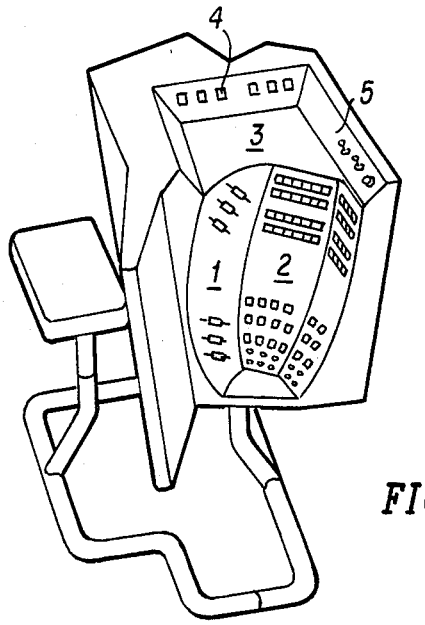
FIG. 1 shows the new layout and design of the main control panel (consisting of Part 1 and Part 2) and the built-in rhythm unit controls set up at the top of the instrument (Part 3, Part 4, and Part 5).

The main control panel assigned to the right hand (FIG. 1, Part 1 and Part 2): Part 1, as it partially shows, is reserved for all slide controls; Part 2, fully visible to the accordionist, is shaped like a very steep, slightly concave water slide shoot that moves gradually toward the accordionist as it gracefully rolls to the bottom. It displays a cascade of color coded, clearly labeled, highly visible switches and push buttons all directing each label (regardless of their location on the panel), toward the natural view field of the accordionist thus eliminating eye squinting, eyestrain, guess work and discomfort.

Figure 2:
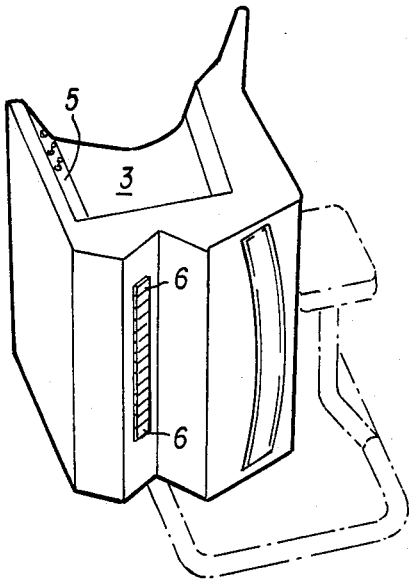
FIG. 2 shows where the bassboard switches are positioned (Part 6).

Bassboard switches (FIG. 2, Part 6) are positioned at a diagonal angle over the bassboard allowing the accordionist to reach for them by just extending upward the needed finger toward the desired switch and engage it with the slight pressure of the fingertip, without ever overreaching.

Built-in rhythm unit (FIG. 1, Part 3, Part 4, and Part 5) controls are positioned in a conveniently designed 3-sided, sunken-in portion of the very top of the instrument (just about where the top bellows locking strap used to be), and again, all the identifying labels and signs follow the same 100% fully detectable principle as the other switches on the main control panel.

Figure 3:
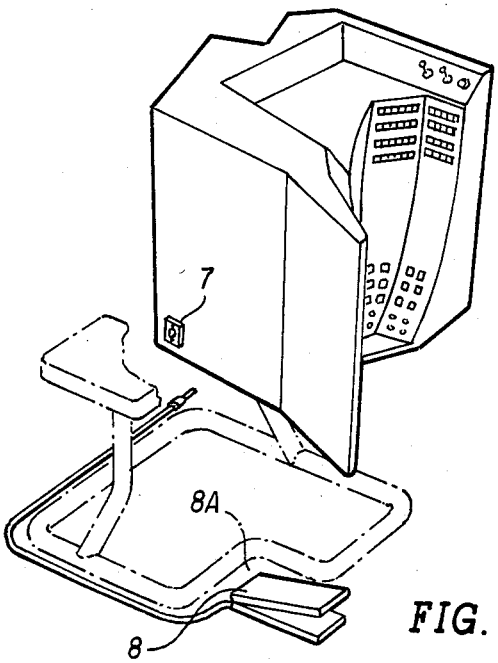
FIG. 3 shows where the main plug is installed (Part 7), the wire leaving the rear right side of the front pedal and following the contour of the platform toward the generator cabinet (Part 8) and the cutout in the front right portion of the platform (Part 9A).

To reduce chances of stumbling over connecting wires and patch cords, the main plug connecting the instrument to the generator cabinet, is now positioned in the lower left corner of the backside of the instrument (see FIG. 3, Part 7). Preferably both amplifier and generator cabinets (if the latter is still needed) should be placed directly behind the Electonic Accordion Housing and Support Stand for a more direct hookup.

The connecting wire of the footpedal (FIG. 3, Part 8) will exit from the rear right side of the pedal and like all other wires or patchcords will follow a protected and semi-concealed route adhering to the contour of the supporting platform, by means of special clips to ultimately reach the generator cabinet in an out of the way sort of fashion.

Special cutout in the right front portion of the platform (FIG. 3, Part 8A) makes the pedal control more restful. While the left foot rests on the front left side of the platform, the cutout allows the pedal to sink in enough to equalize the elevation of both feet, thus providing a better balanced body-weight distribution resulting in added comfort.

The specific electronic hardware used in the instant invention is conventional and available off-the-self in conventional electronic accordions and does not constitute a part of the instant invention, which is directed to the shape and contour of the accordion housing and control location, as well as a supporting stand and seat for the accordian and performer, respectively.

The "Sound Machine" (see FIG. 4) is firmly attached to its tilt-action, height-adjustable with 360 degrees rotation flexibility, supporting plate by joining its four stabilizing pins with the four matching cavities at the bottom of the instrument cases (see FIG. 4 illustrating 23 with 24; 25 with 26; 29 with 30; 31 with 32) and by tightening locking screw Part 22 into its matching threaded cavities (27 and 28). Once the instrument is locked in place, the supporting metal plate Part 9 with its tilt-action adjusting knob Part 40, allows to obtain the desired angle needed for the instrument. The descending spiral-threaded supporting stem Part 11 offers both a 360 degrees swivel motion (rotation) of the instrument and the flexibility of raising or lowering it to the desired height. All this is generously supported by Part 12, which in turn slips into its matching lower sleeve (Part 13), which is the upper segment of the left half of the platform (Part 14). Part 16 is the right half of the basic platform that interlocks with Part 14. Its upper portion is Part 17 which is the suppporting sleeve for Part 19, that in turn holds Part 20 (the spiral-threaded stem) that allows proper elevation of the approximately 6"×12" rectangular padded seat (Part 21).

The bassboard strap (Part 37), by the way, is still part of the instrument as if it were on a traditional accordion (it's not omitted).

The Electronic Accordion Housing is also equipped with traditional shoulder straps attachments so that it can be played, if so desired, like a traditional electronic accordion (of course without the bellows). Moreover, the five connecting points at the very bottom of the instrument (Part 34) are turned toward the inside of the case and perfectly flush with its surface and absolutely of no hindrance.

The basic height of the Electronic Accordion Housing is the same as that of a standard full-size electronic accordion. (Same dimensions for both keyboard and bassboard). Its depth of course is a lot deeper, at least 12"-13". It could be even deeper, or not quite as deep. The width is basically the same as that of a standard electronic accordion (measuring from left outer edge of the bassboard Part 36 to the far right of the keyboard Part 33) across the back of the instrument. Both Part 33 and Part 36 remain unchanged with respect to the traditional electronic accordion especially the depth of Part 36 which is of paramount importance to the dexterity of the left hand.

The width of the platform is 28", the depth from back to front is 29". To determine the center point of the seat's supporting stem with respect to the platform, we start from the rear right corner (considering it as if it were a square one not a round one) and moving toward the front of the platform along the right side of the same we stop at the 9½" mark. At this point the section that is supposed to support the seat starts rising from the basic frame at a 45 degrees angle, toward the inside of the platform and in a perfectly paralled direction with the back side of the platform, for a length of 10½" at which point in turns straight upwards in a perfectly perpendicular direction that becomes the very center of the seat, which with respect to the platform is 10" inside the platform from the rear right side outer edge, 9½" inside the platform from the right portion of the back side outer edge, and 18" inside platform from rear left side outer edge.

Leaving the front left corner of the platform moving toward the back along its left side, the 11¼" mark establishes the point from which the center of the instrument supporting arm starts rising from the basic platform at a 45 degrees angle (in a paralled direction with the front portion of the platform and toward its inside) for a length of 8½" at which point it turns to a straight up, vertical direction to become at a higher point the receptacle of the spiral-threaded stem topped by the instrument supporting plate. The very center of this stem with respect to platform's perimeter, is 8" (inside platform) from the outer edge of the left side of the front part, 11" (inside platform) from outer edge of left side's front segment and 19¾ inches from outer edge of left portion of the back side.

The shape of the upper portion of the instrument supporting plate is that of an elongated, irregular pentagon. Starting from the left side clockwise, here are the measurements of its five sides: 5"×9¾"×3"×3"×9¾". Its main portion is an irregular rectangle approximately 9¾" long measuring at one end 5" wide and at the other end 5½" wide, this end then extends into a triangle with a center peak 1¼" long and two slopes each 3" long. The supporting plate's size to conclude must not be wider nor longer than the surface that the bottom part of the instrument has to offer. As illustrated in FIG. 4, both Part 14 and Part 16, can be pulled completely apart to disassemble the platform, or simply pulled "partially" apart to increase the basic width of the platform if needed to create more space between the instrument and the seat for extra heavy or extra tall individuals. Once the desired position of the platform is obtained the two basic halves can easily be secured by means of the locking pins to be inserted in the perforations provided at both points 15 and 18 where the two halves interlock with one another in a telescopic fashion. The seat's average height should extend from approximately 20" to 30". The instrument supporting plate's stem should extend from 25" to approximately 36". Of course the range between the minimum and the maximum height is determined and decided by the manufacturer and naturally it can be decreased even more to accommodate shorter individuals and increased all the way for extra tall and large adults.

The large front surface of the instrument (Part 35) lends itself to displaying the factory's, the instrument's, the accordionist's name, or any kind of artistic decoration the manufacturer deems suitable or most appropriate.

DESCRIPTION OF THE "BRIEF-CASE"

The "Brief-Case" is the fully portable, totally collapsible version of the lower section of the Electronic Accordion Housing.

The shell of the "Brief-Case" can be made out of plywood (¾"), out of metal or out of synthetic materials.

Figure 5A:
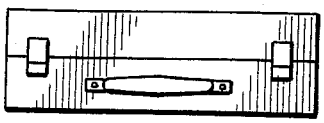

FIG. 5A shows the "Brief-Case" depth when fully closed.

Figure 5B:
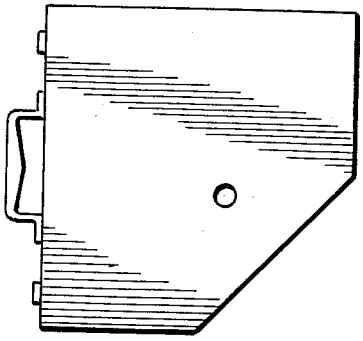

FIG. 5B shows its over-all dimensions including one of the two cylindrical shaped cavities that function as sleeves to receive the two bottom stems (precisely moulded for a tight perfect fit) of the two sectionally mounted supporting columns.

Figure 5C:
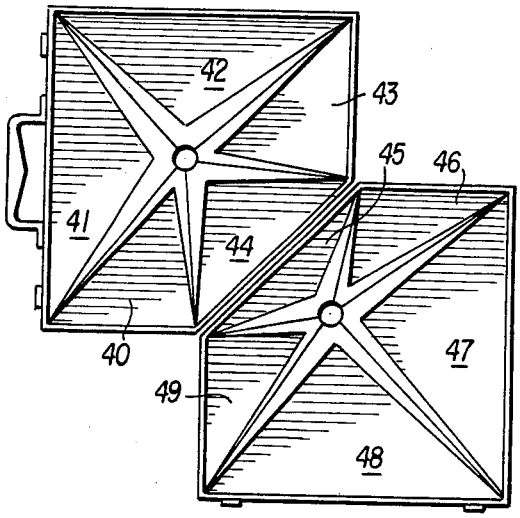

FIG. 5C shows the "Brief-Case" fully open, revealing the actual under side of the platform. Each one of the two irregular pentagons (held together by a piano hinge), are strengthened by a five point, starfish shaped metal brace. Each star's five points extend from a central hub (shaped like an inverted cup), to the five corners of each one of the two halves of the "Brief-Case" for added stability and solidity.

Figure 5D:
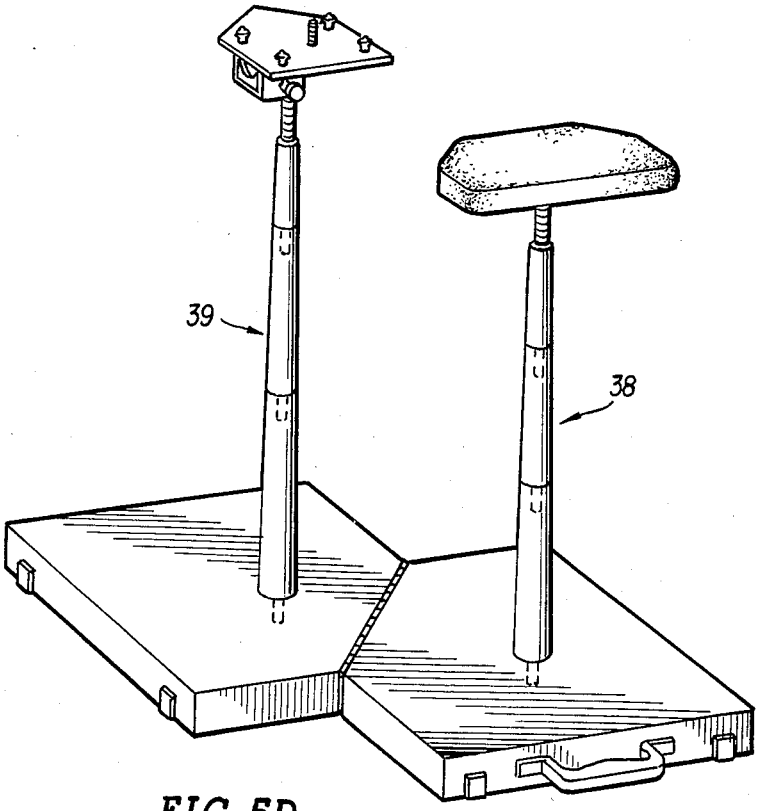

FIG. 5D shows the two halves turned completely over (upside-down), this time concealing the two starfish shaped braces, and now displaying a smooth and neat platform rising about three inches from the floor with the two columns already mounted (by means of interlocking stems) into the two cylindrical cavities (which are the opposite ends of the hubs of the two star shaped braces).

Part 39 is 30" high. Part 38 is 24" high. Regardless of their respective height both columns should be of cylindrical, slightly conical shape, starting at the point of contact with the platform with a 3" diameter and gradually reducing to a 2" diameter at the top. Each column consists of three stackable segments (by means of 3" long, 1½" in diameter cylindrical stems). Part 39 (30" high) bottom segment is 12" long, middle section is 10" long, and top section is 8" long. Part 38 (24" high) bottom segment is 10" long, middle section is 8" long, and top section is 6" long. All six segments, regardless of their length or variable diameter, have one thing in common: the bottom end of each one of them extends into a 3" long, 1½" diameter stem. The top end of the bottom and middle segment of both columns offers a precisely fitting, cylindrical cavity to match its corresponding stem like a glove. However the upper end of the third segment of the two columns is grooved to precisely match the ¾ spiral threaded stem of both the fully adjustable instrument supporting plate and the seat.

The two halves offer a total of ten compartments (FIG. 5C, numbered 40 through 49). Part 39 has three basic interlocking segments plus the upper portion of the instrument supporting plate, and the spiral threaded stem which is permanently attached to the lower half of the instrument supporting plate, making a total of five pieces. Part 38 also breaks down in five sections (three basic interlocking segments plus the seat and its supporting spiral threaded stem).

It is therefore quite clear that the ten pieces of the two columns can be conveniently stored in the ten compartments provided by the two halves (FIG. 5C numbered 40 to 49). Each piece is secured in its compartment by means of Velcro straps. Once every piece is secured, the two halves are folded and the "Brief-Case" is ready to go.

I claim:

1. An electronic accordion support means comprising:

a horizontal tubular base means having a plurality of sides;

first and second vertical posts mounted on said base;

a seat for a performer mounted on said first post, said seat including height adjustment means;

an accordion unit mounted on said second post by a mounting means;

said mounting means comprising a support plate, four stabilizer pins, and one central locking bolt, said mounting means enabling said accordion unit to pivot 360°, to be adjusted in height, and to be adjusted in degree of inclination to fit the needs of a performer.

2. The electronic accordion of claim 1, in which said accordion unit contains a vertically oriented right-hand keyboard which faces away from a performer when said accordion unit is pivoted on said second post into a performance position.

3. The electronic accordion of claim 1, in which said accordion unit contains a vertically oriented left-hand bassboard which faces away from a performer when said accordion unit is pivoted on said second post into a performance position.

4. An electronic accordion housing comprising:

a vertical back surface;

a vertically oriented right-hand keyboard which faces away from said back surface;

a vertically oriented left-hand bassboard which faces away from said back surface;

a main control panel adjacent said right-hand vertically oriented keyboard, said panel originating from an inner edge of said right-hand keyboard, said panel comprising a relatively wide semicircular concave top portion which gradually narrows in a downward direction to a smaller semicylindrical bottom portion, said panel forming a main control surface, at least a portion of which faces in substantially the same direction as said back surface.

5. Apparatus in accordance with claim 4 in which adjacent said left-hand vertically oriented bassboard is positioned a bassboard control surface which from a point beyond an inner edge of said bassboard and with respect to said bassboard forms an acute angle, said surface extending at least the vertical length of said bassboard.

6. Apparatus in accordance with claim 4 in which said housing further comprises a top control panel located on a sunken-in portion of a flat top portion of said housing and said sunken-in control panel consists of a main horizontal surface, a sloped narrow surface facing away from said back surface, and a sloped narrow surface facing substantially the same direction as said back surface that extends itself beyond said horizontal surface and elongates over at least a portion of said concave top portion of said main control panel.

7. Apparatus in accordance with claim 5 in which a left-most edge of said bassboard control panel and a right-most edge of said main control panel are joined by a front surface which comprises a removable panel.

* * * * *